United States Patent [19]

Evans

[11] 4,245,223

[45] Jan. 13, 1981

[54] SELF-MULTIPLEXING ANTENNA EMPLOYING ORTHOGONAL BEAMS

[75] Inventor: Gary E. Evans, Baltimore, Md.

[73] Assignee: The United States of America as represented by the Secretary of the Navy, Washington, D.C.

[21] Appl. No.: 793,030

[22] Filed: May 2, 1977

[51] Int. Cl.[3] ..... H01Q 19/12; H01Q 21/22

[52] U.S. Cl. ..... 343/778; 343/779

[58] Field of Search ..... 343/854, 778, 779, 853, 343/100 SA

[56] References Cited

U.S. PATENT DOCUMENTS

| | | | |
|---|---|---|---|
| 3,093,826 | 6/1963 | Fink | 343/854 |
| 3,276,018 | 9/1966 | Butler | 343/854 |
| 3,293,648 | 12/1966 | Kuhn | 343/854 |
| 3,295,134 | 12/1966 | Lowe | 343/854 |

*Primary Examiner*—Eli Lieberman

*Attorney, Agent, or Firm*—Richard S. Sciascia; J. M. St. Amand; Darrell E. Hollis

[57] ABSTRACT

A self-multiplexing antenna comprising an array of radiating elements for radiating a plurality of orthogonal beams in response to wave energy excitations applied thereto. A plurality of first transmission lines are connected between respective radiating elements and respective resistive terminations. A plurality of second transmission lines are connected between respective input ports and respective resistive terminations. A plurality of directional couplers couple wave energy from each input port to each radiating element in the array via the first and second transmission lines whereby wave energy from each input port generates a separate orthogonal beam from the array of radiating elements.

3 Claims, 15 Drawing Figures

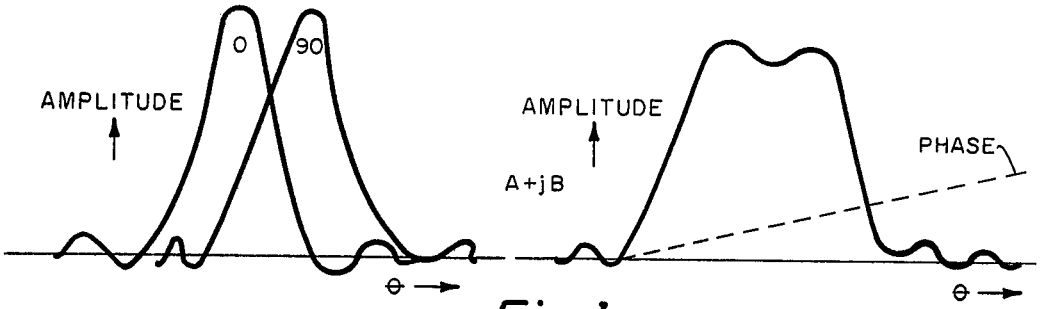
Fig. 1a.
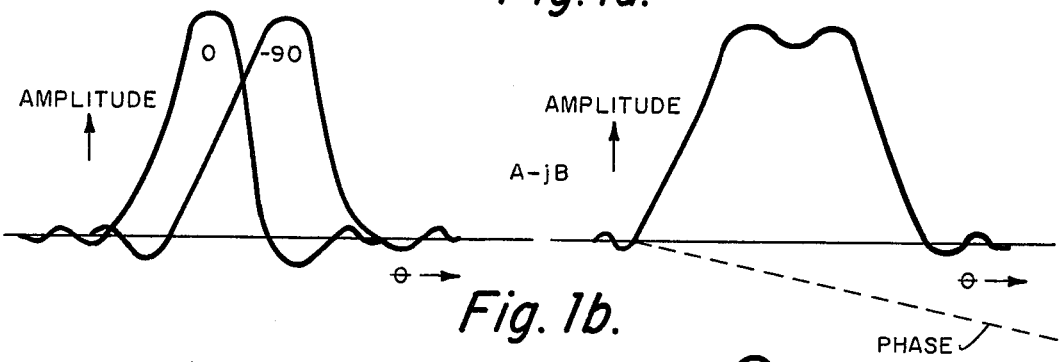
Fig. 1b.
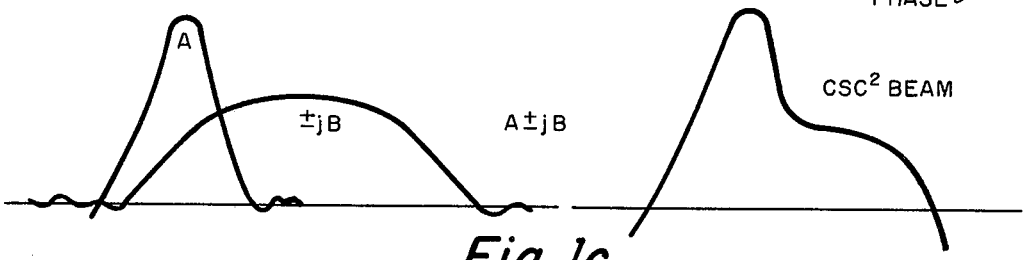
Fig. 1c.
Fig. 2a.
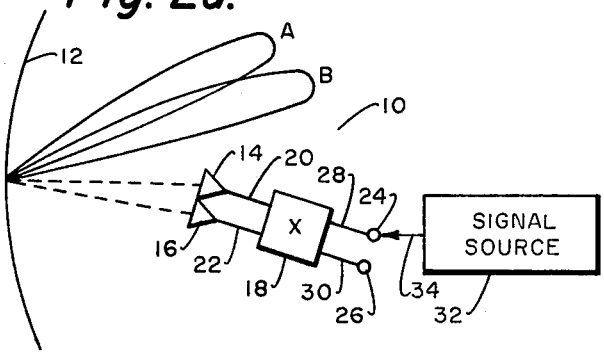
Fig. 2b.
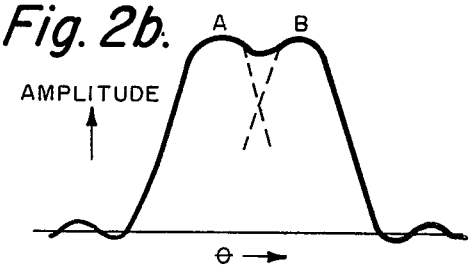
Fig. 4a.
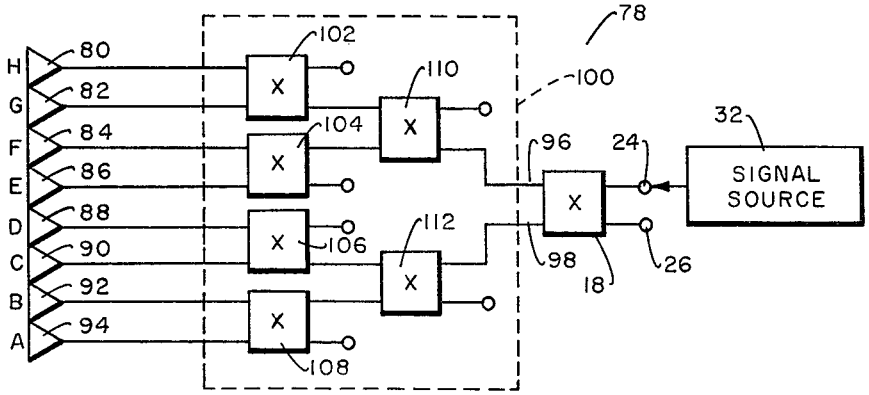

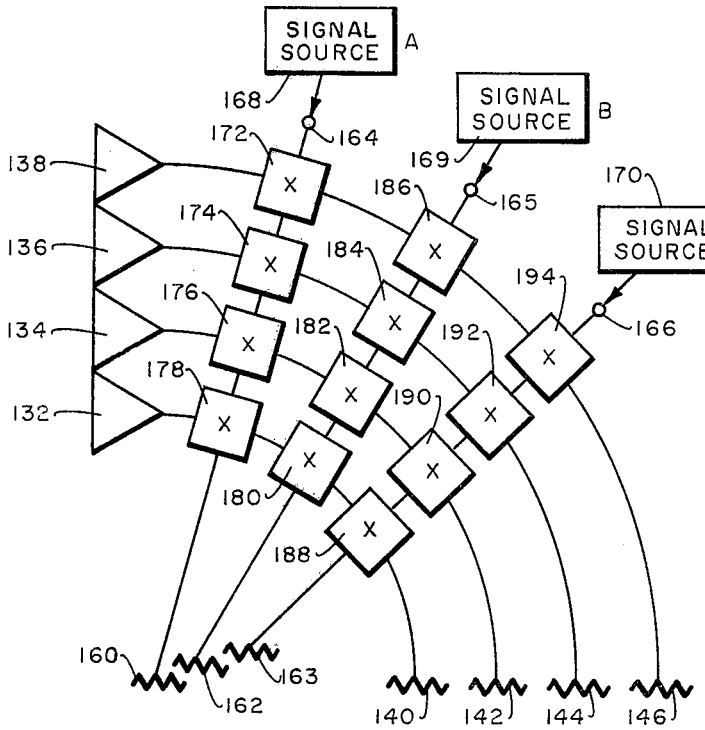
Fig. 6a.
Fig. 6b.
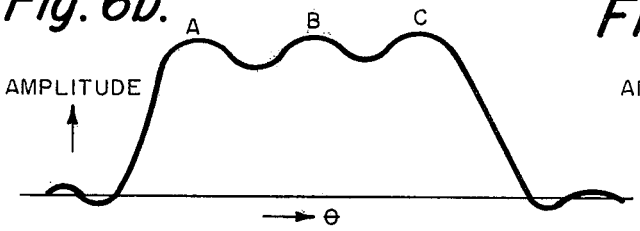
Fig. 7b.
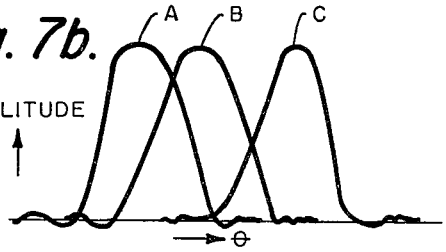
Fig. 7a.
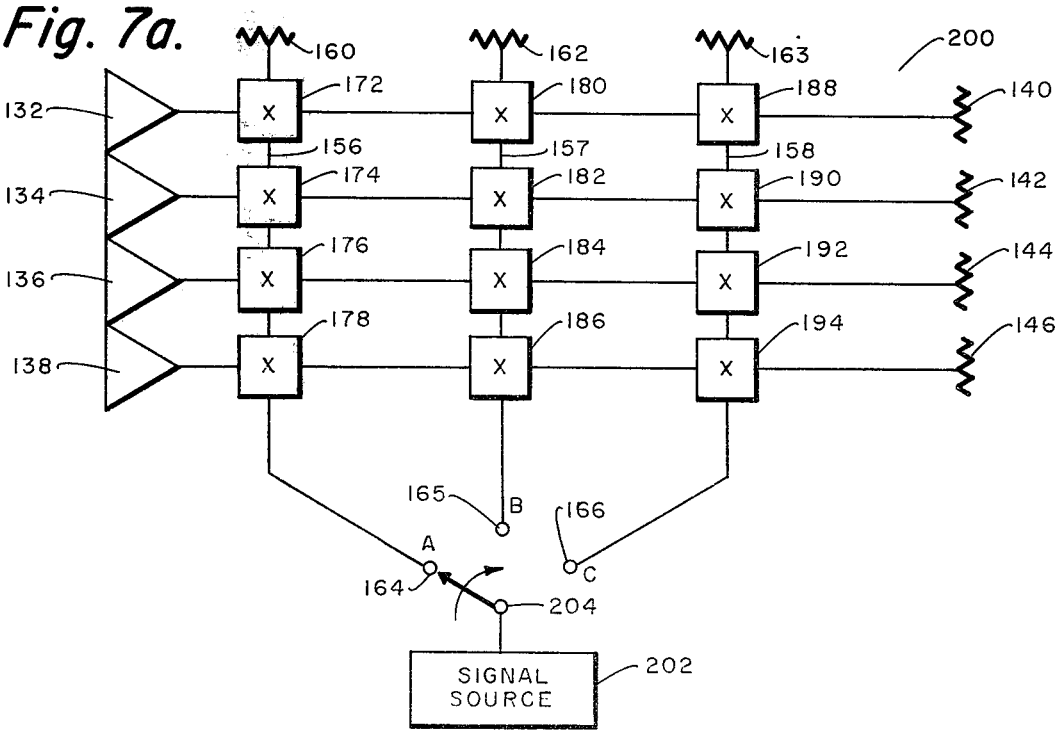

SELF-MULTIPLEXING ANTENNA EMPLOYING ORTHOGONAL BEAMS

BACKGROUND OF THE INVENTION

1. Field of the Invention

The present invention relates generally to antenna systems for radiating wave energy beams and more particularly to antenna systems which radiate a plurality of orthogonal beams.

2. Description of the Prior Art

It is well known that most any desired wave energy pattern may be approximately achieved using a combination of component antenna beams which result from component aperture excitations. The desired wave energy pattern results from the superposition of the component beams in space, and a corresponding composite aperture excitation is determined by the superposition of the component aperture excitations.

In practice, it is convenient to choose component aperture excitations which radiate an orthogonal set of component beams. In a conventional orthogonal set of antenna beams, each beam has a direction of maximum radiation associated with it, in which direction all other beams in the orthogonal set exhibit a radiation null. Using an orthogonal set of component antenna beams results in there being a corresponding set of directions in space at each of which the amplitude of radiation is predominantly determined by the amplitude of a single component aperture excitation.

In order to radiate multiple overlapping beams, most prior art radar systems have found that channel separation was a necessity. In particular, such prior art systems were forced to employ duplexers, filters, and switches in order to achieve the desired channel separation. These systems tacitly assume that orthogonality requires displacing the beams in angle.

SUMMARY OF THE INVENTION

The present invention overcomes the above-described disadvantages, among others, by providing an antenna system which radiates a plurality of orthogonal beams from a common aperture. The radiated beams are orthogonal by virtue of the phase variations across them in space. One embodiment of the present invention utilizes an array of radiating elements as a common aperture with a plurality of first transmission lines being connected between respective radiating elements and respective resistive terminations. A plurality of second transmission lines are connected between respective input ports and respective resistive terminations. A plurality of directional couplers couple wave energy from each input port to each radiating element in the array via the first and second transmission lines whereby wave energy introduced into each input port generates a separate orthogonal beam from the array of radiating elements.

Accordingly, one object of the present invention is to provide a plurality of orthogonal beams radiated from a common aperture.

Another object of the present invention is to provide an antenna system capable of radiating a plurality of orthogonal beams in space by varying the phase across the beams in space.

A still further object of the present invention is to reduce the amount of electronic components necessary to radiate orthogonal beams.

Another object of the present invention is to decrease cost and increase efficiency and reliability.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

BRIEF DESCRIPTION OF THE DRAWINGS

FIGS. 1*a*–1*c* graphically illustrate beams that are orthogonal by virtue of the phase variation across them in space.

FIGS. 2*a* and 2*b* illustrate one embodiment of the present invention utilizing a reflector.

FIGS. 4*a* and 4*b* illustrate another embodiment of the present invention.

FIGS. 6*a* and 6*b* illustrate an embodiment of the present invention related to the embodiment of FIGS. 5*a* and 5*b*.

FIGS. 7*a* and 7*b* illustrate another embodiment of the present invention.

DETAILED DESCRIPTION OF THE PREFERRED EMBODIMENT

Figure 4B:
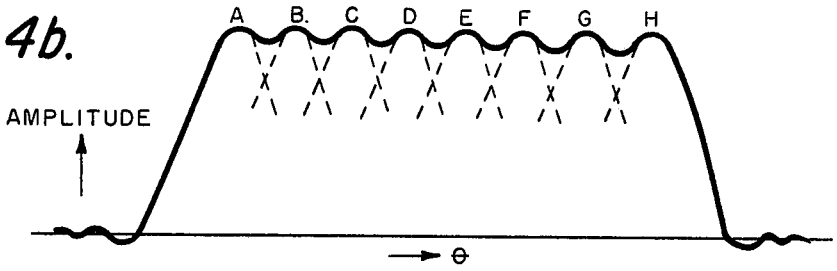

It is often extremely desirable in radar systems to use a common antenna array for multiple purposes such as transmitting and receiving, radar and beacon, multiple channels, etc. In order to accomplish this, prior art systems have found it necessary to separate the channels with duplexers, filters, and switches, as alternatives to displacing the beams in angle in order to achieve orthogonality.

It is well known that an antenna can produce several loss-less beams from a common aperture at a common polarization if each of the beams are orthogonal. Prior art systems are limited by the constraint that the beams be displaced in angle. However, beams can be orthogonal by virtue of the phase variation across them in space, even though they have identically superimposed amplitude patterns.

FIGS. 1*a* through 1*c* illustrate three simplified cases showing how two superimposed beams, A and B, can be rendered orthogonal by virtue of the phase variation across them in space. As is shown in FIGS. 1*a* through 1*c*, the components making up the shaped beam are phase zero degrees and 90 degrees or zero degrees and −90 degrees with respect to each other. Consequently, they can be driven simultaneously through a 90 degree hybrid coupler with negligible losses.

Mathematically, the integral of the product across the angular region is $$\int_{\theta} (A + jB)(A - jB)^{*}\, d\theta = \int_{\theta} (A^2 - B^2 + 2jAB)\, d\theta = 0$$

if the powers in A and B are equal and if they are themselves orthogonal. A and B are conventional radio frequency signals.

The antenna system 10 illustrated in FIG. 2*a* includes a reflector 12 and a pair of radiating horns 14 and 16.

Feed horns 14 and 16 are connected to directional coupler 18 via transmission lines 20 and 22. Input ports 24 and 26 are connected to directional coupler 18 via transmission lines 28 and 30, respectively. Signal source 32 introduces a conventional radio frequency signal into input port 24 via transmission line 34. The signal introduced from signal source 32 into input port 24 produces the pattern shape illustrated in FIG. 2*b* from the beams labeled A and B of FIG. 2*a*. Driving either input 24 or input 26 will produce the identical pattern shape illustrated in FIG. 2*b*.

Directional coupler 18 is of conventional design and any of a number of conventional designs may be used, such as can be found in: Microwave Engineers Handbook, Horizon House 1964, Pages 109–121; and, Stripline Circuit Design, Artech House Inc., by Harlan Howe, Jr., (1974), CH 3, 4 & 5, Pages 77–180. The directional couplers referred to below in other figures of the drawings are also of conventional design and the types indicated above can be used.

Ordinarily it is impossible to produce such identical patterns as shown in FIG. 2*b* at two independent terminals unless loss is introduced. However, by virture of the phase change across the beam, they are orthogonal, thus introducing no losses. The signal introduced into input port 24 is divided by directional coupler 18 such that wave energy excitations on feed horns 14 and 16 produce a pair of orthogonal radiated beams having equal power. Feed horn 14, by itself, radiates the beam labeled A in FIG. 2*a* and feed horn 16, by itself, radiates the beam labeled B in FIG. 2*a*.

The beams, A and B, are displaced by virtue of the placement of feed horns 14 and 16 off the focal axis of the parabolic reflector 12. When a conventional radio frequency signal is introduced into input port 24, feed horns 14 and 16 each serve as separate apertures and are both excited but with a phase difference of 90 degrees introduced by the nature of the directional coupler 18 and composite beam results, as is illustrated in FIG. 2*b*.

There are two ways to place the feed horns 14 and 16 in quadrature; with the feed horn 16 either lagging or leading in phase relative to the feed horn 14. By introducing the signal into input port 26 rather than input port 24, the beam radiated from horn 16 leads the beams radiated by horn 14 in phase. Driving the antenna system 10 from input port 26 divides the power equally but now reverses the relative phasing of the horns 14 and 16. Accompanying this phenomenon is a corresponding reversal in the relative phasing of the component beams A and B. The combination of the two beams A and B once again produces the amplitude shape, as shown in FIG. 2*b*, although an unseen phase change has taken place. Thus, the antenna system 10 by utilizing the inputs 24 and 26 can independently produce identically-shaped beams from a common reflector without loss.

Figure 3A:
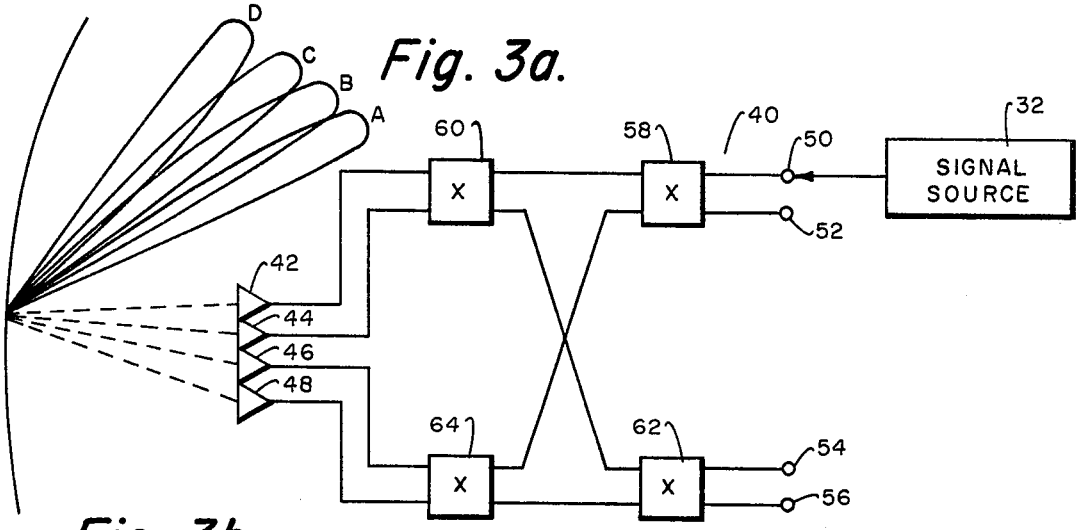
FIGS. 3*a* and 3*b* illustrate an embodiment of the present invention related to the embodiment of FIGS. 2*a* and 2*b*.

FIG. 3*a* illustrates an antenna system 40 which is an expanded version of the antenna system 10 shown in FIG. 2*a*. Antenna system 40 includes feed horns 42, 44, 46 and 48 which radiate orthogonal beams A, B, C, D, respectively.

Directional couplers 58, 60, 62 and 64 are interconnected via transmission lines between feed horns 42 through 48 and input ports 50 through 56. It is noted that input ports 50 through 56 are connected in pairs to directional couplers 58 through 64. As shown in FIG. 3*a*, input port 50 is connected along with input port 52 to directional coupler 58 while input ports 54 and 56 are connected to directional coupler 62.

Figure 3B:
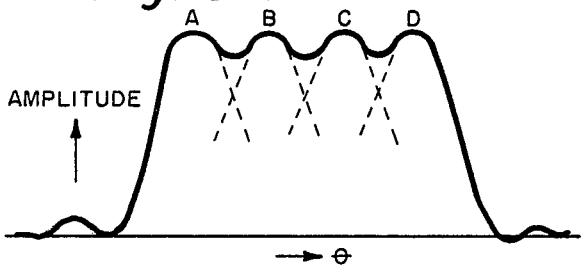

Signal source 32 is shown driving input port 50. However, signal source 32 can be connected to drive either input ports 50, 52, 54 and 56 to produce the amplitude pattern shown in FIG. 3*b*.

A conventional radio frequency signal introduced into either input port 50 or 52 would be divided by directional coupler 58 such that wave energy excitations on feed horns 42–48 produce four orthogonal radiated beams having equal power. The wave pattern of the four beams is graphically illustrated in FIG. 3*b*. Likewise, a conventional radio frequency signal introduced into either input port 54 or 56 would be divided by directional coupler 62 such that wave energy excitations on feed horns 42–48 produce four orthogonal radiated beams having equal power. Thus, any one of the four inputs can independently produce identically-shaped beams from a common reflector without loss.

It is noted that the embodiment shown in FIG. 3*a* is an expansion of the embodiment of FIG. 2*a* from two horns to four feed horns. This embodiment can be expanded in similar fashion to include many more feed horns if desired.

FIG. 4*a* illustrates antenna system 78 which includes an array of feed horns 80 through 94. Signal source 32 introduces a signal into input port 24 which drives directional coupler 18. The outputs 96 and 98 from directional coupler 18 are connected to matrix 100.

Matrix 100 is comprised of directional couplers 102, 104, 106, 108, 110 and 112. It is noted that the directional couplers 102 through 112 form a geometric progression pattern with the outputs from one level of the geometric progression forming the inputs to the next level in the geometric progression. The directional couplers 102 through 112 located within matrix 100 are interconnected by transmission lines. Each of the feed horns 80 through 94 serve as separate apertures and each radiate an orthogonal beam which, when taken together, form the wave pattern shown in FIG. 4*b*. It is noted that the radio frequency signal introduced into directional couplers 18, 110, 112, 102, 104, 106 and 108 has its power divided equally between the outputs of the directional couplers with each output being orthogonal to the other output.

The embodiment illustrated in FIG. 4*a* contains only eight feed horns but can easily be expanded in similar fashion to include many more feed horns, if desired. For example, the number of directional couplers within matrix 100 could be increased by eight to accommodate eight additional feed horns thereby radiating eight additional orthogonal beams.

Signal source 32 can be introduced into either input port 24 or 26 to produce wave energy excitations to cause feed horns 80–94 to radiate the wave pattern shown in FIG. 4*b*.

Figure 5B:
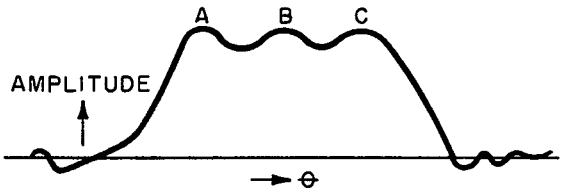
FIGS. 5*a* and 5*b* illustrate still another embodiment of the present invention.
Figure 5A:
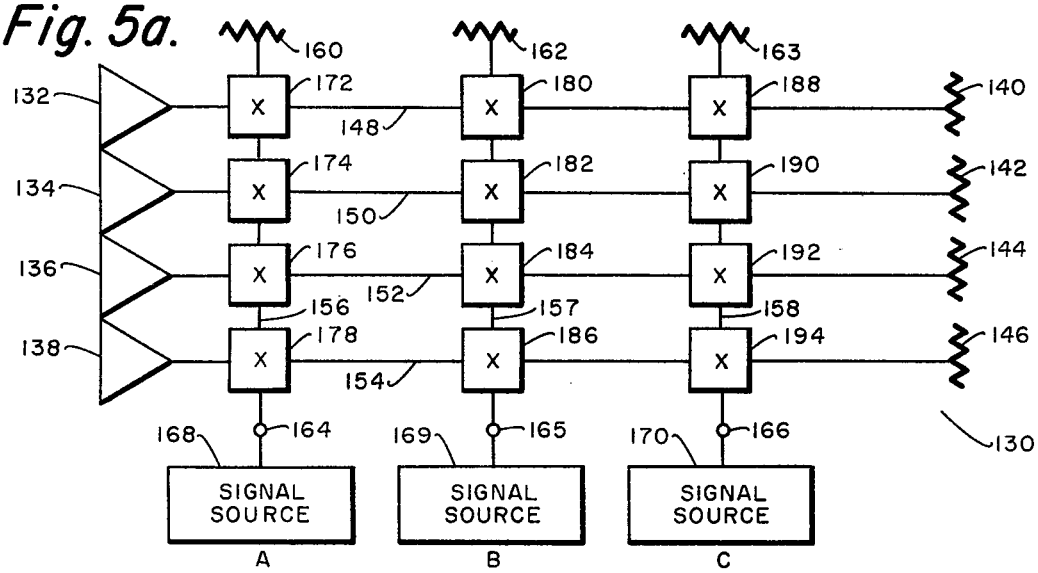

The antenna system 130 illustrated in FIG. 5*a* includes a linear array of antenna horns 132, 134, 136 and 138. Each feed horn 132 to 138 is connected to a respective resistive termination 140 through 146 via respective horizontal transmission lines 148 through 154. Signal sources 168, 169 and 170 introduce signals into input ports 164, 165 and 166, respectively. Input ports 164, 165 and 166 are connected to vertical transmission lines 156, 157 and 158. Transmission lines 164, 165 and 166 terminate in resistive terminations 160, 162 and 163, respectively.

Vertical transmission line 156 is coupled to horizontal transmission lines 148 through 154 via cross guide couplers 172 through 178. Vertical transmission line 157 is coupled to horizontal transmission lines 148 through 154 via cross guide couplers 180, 182, 184, and 186. Vertical transmission line 158 is coupled to horizontal transmission lines 148 through 154 via cross guide couplers 188, 190, 192 and 194.

The feed horns 132–138 form an antenna aperture which will radiate wave energy patterns in response to wave energy excitations on the aperture. A wave energy excitation is developed on the aperture by supplying to the individual feed horns 132 through 138 wave energy signals having preselected relative amplitudes and phases.

The spacing of the feed horns 132–138 along the linear array, the length of the linear array, and the number of feed horns 132–138 required are chosen in accordance with principles which are familiar to those skilled in the art. It will be evident that other antenna elements besides feed horns may be used to construct the linear arrays of FIGS. *5a*, *6a* and *7a*. Other commonly used antenna elements are dipoles, waveguide slots, and spirals.

In the embodiments of FIGS. *5a*, *6a* and *7a*, wave energy signals are supplied from radio frequency signal sources 168–170 to feed horns 132–138 via input ports 164–166 by means of vertical transmission lines 156–158, horizontal transmission lines 148–154, directional couplers 172–194. It will be evident to one skilled in the art that the amplitude of the wave energy signals coupled to each of the feed horns 132–138 is regulated by the coupling coefficients of the various directional couplers 172–194. The phase of the wave energy signals coupled to each of the feed horns 132–138 is determined by the phase length of the vertical and horizontal transmission lines 148–158 and the directional couplers 172–194. It is evident that the structure provides for individual adjustment of the amplitude and phase of wave energy signals that are simultaneously coupled to each of feed horns 132–138.

For operation of antenna system 130, the appropriate power at the appropriate phase is tapped from each vertical transmission line 156 through 158 and coupled to feed horns 132 through 138 via horizontal transmission lines 148 through 154. Directional couplers 172 through 178 couple power from vertical transmission line 156 to each horizontal transmission line 172 through 178. Directional couplers 180 through 186 couple power from vertical transmission line 157 to each horizontal transmission line 172 through 178. Directional couplers 188 through 194 couple power from vertical transmission line 158 to each horizontal transmission line 172 through 178.

Each signal source 168 through 170 and its related vertical transmission lines generates an independent orthogonal beam through feed horns 132 through 138, as shown in FIG. *5b*. The beams are orthogonal in phase rather than angles.

The coupling coefficients of directional couplers 172 through 178 are chosen by standard computing procedures. The coupling coefficients of directional couplers 180 through 186 are chosen by standard computing procedures that take into account the coupling coefficients of directional couplers 172 through 178. The coupling coefficients of directional couplers 188 through 194 are chosen by standard computing procedures that take into account the coupling coefficients of directional couplers 172 through 178 and 180 through 186.

The independence of signal sources 168 through 170 depend on the orthogonality of the beams radiated. If the radiated beams were not orthogonal, power coupled to horizontal transmission lines 148 through 154 from signal sources 169 and 170 would find its way into the loads of vertical transmission lines 156 and 157 and would be lost as far as a useful radiation is concerned. Thus, radiators 132 through 138 can be driven simultaneously by signal sources 168 through 170, radiating three beams A, B and C, as shown in FIG. *5b*. It is noted that additional feed horns, additional vertical transmission lines, and additional horizontal transmission lines may be employed in antenna system 130 to generate additional orthogonal beams.

It is noted that in this array, as in any array, each of the individual radiators 132 through 138, by itself, is capable of producing a pattern. It is the phase combination of the elemental patterns that produces the beam shape desired.

The array antenna system 130, shown in FIG. *5a*, is known to suffer from variations in steering angle with frequency. This problem is overcome by utilizing the embodiment illustrated in FIG. *6a*. The steering angle error occurs because of the different line lengths from the input ports 164 through 166 to the radiators 132 through 138. For instance, in FIG. *5a*, the distance from input port 164 to radiator 138 is less than the distance from input port 164 to radiator 132. The embodiment illustrated in FIG. *6a* overcomes this steering angle problem by curving horizontal transmission lines 154 and 152 to render the distances from each input port 164 through 166 to the radiators 132 through 138 equal.

FIG. *6b* illustrates the wave pattern formed by the individual beams A, B and C radiated by feed horns 132 through 138 in response to wave energy excitation from signal sources 168 through 170. Again, additional feed horns, additional vertical transmission lines and additional horizontal transmission lines may be employed in the embodiment of FIG. *6a* to generate additional orthogonal beams.

Antenna system 200 of FIG. *7a* is a specific application of antenna system 130 of FIG. *5a*. Many radar and beacon systems use an elevation pattern with a steep slope on the underside to avoid illuminating the ground. In FIG. *7b*, the left hand skirt of A corresponds to the horizon. In such applications, it is often desirable to raise such a beam over an obstacle at particular azimuths. Thus, as switch 204 traverses from input port 164 to input port 166, the left hand skirt in FIG. *7b* moves from left to right.

In the embodiments illustrated in FIGS. *5a*, *6b* and *7a*, the transmission line ends remote from the radiation elements 132 through 138 are terminated in matched impedances or resistive terminations 140 through 146 and 160 through 163 to improve element-to-element isolation, absorb extraneous unradiated power, and minimize perturbation due to finite directivity of the directional couplers.

The transmission lines used in the embodiments of FIGS. *2a*, *3a*, *4a*, *5a*, *6a* and *7a* may be of any type appropriate for use at the operating frequency of the antenna. Typical transmission lines which might be used are waveguides, coaxial lines, and strip transmission lines. The directional couplers may be any type appropriate to the chosen transmission line type. Those skilled in the art will recognize that other means, besides directional couplers, may be used to supply wave energy signals to the radiating elements from the input ports. Examples include reactive power dividers or enclosed multi-mode transmission lines.

Obviously numerous modifications and variations of the present invention are possible in light of the above teachings. It is therefore to be understood that within the scope of the appended claims the invention may be practiced otherwise than as specifically described herein.

What is claimed is:

1. An antenna system for radiating wave energy in a desired radiation pattern comprising:

a. antenna means for radiating a plurality of superimposed beams comprising a wave energy pattern from a common aperture in response to sources of wave energy excitations applied thereto, said antenna means including an array of radiating elements as a common aperture;

b. a common reflector disposed adjacent said antenna means to reflect said plurality of superimposed beams comprising a wave energy pattern; and c. means for supplying said wave energy excitations to said antenna means with predetermined relative phases and amplitudes to develop said wave energy patterns with each said beam therein being orthogonal in phase with respect to each other said beam by virtue of phase variation across said beams in space due to predetermined relative phases of said wave energy even when the amplitudes thereof are identical;

d. said wave energy applied to each said input port generating a separate orthogonal beam from each of said radiating elements;

e. said supplying means including:

(1) at least one input port; and (2) a matrix of directional couplers coupled between each said input port and said radiating elements such that said matrix includes a plurality of series-conducted levels with the number of directional couplers in each level being related to the number of directional couplers in adjacent levels by geometric progression, said directional couplers being interconnected between levels by transmission lines;

f. the phase difference between each of said beams being introduced by said directional coupler matrix; said beams operable to be displaced by displacement of said radiating elements off the focal axis of said common reflector;

whereby each wave energy source applied to any one of said at least one input port will independently produce a plurality of identically shaped beams from said radiating elements without loss and the beams being radiated from said common reflector being orthogonal in phase rather than angles, the phase combination of the plurality of beams producing the desired wave energy pattern.

2. The apparatus of claim 1 wherein said array includes a linear array.

3. The apparatus of claim 1 wherein said plurality of series-connected levels includes a first level and an Nth level, said first level comprising a single directional coupler coupled to said input port, said Nth level comprising N directional couplers coupled to N times 2 radiating elements.

* * * * *